US011944221B2

(12) United States Patent
Park et al.

(10) Patent No.: US 11,944,221 B2
(45) Date of Patent: Apr. 2, 2024

(54) CERVICAL SPINE SUPPORTING PILLOW AND METHOD OF MANUFACTURING SAME

(71) Applicant: JSD1, Seoul (KR)

(72) Inventors: Byung Mo Park, Hanam-si (KR); Han Keel Yoo, Seoul (KR); Chung Soo Kim, Seoul (KR)

(73) Assignee: JSD1, Seoul (KR)

( * ) Notice: Subject to any disclaimer, the term of this patent is extended or adjusted under 35 U.S.C. 154(b) by 190 days.

(21) Appl. No.: 17/496,793

(22) Filed: Oct. 8, 2021

(65) Prior Publication Data

US 2022/0183484 A1 Jun. 16, 2022

(30) Foreign Application Priority Data

Dec. 11, 2020 (KR) ..... 10-2020-0173035

(51) Int. Cl.
*A47G 9/10* (2006.01)

(52) U.S. Cl.
CPC ..... *A47G 9/1081* (2013.01)

(58) Field of Classification Search
CPC ..... A47G 9/10; A47G 9/1054; A47G 9/1072; A47G 9/1081; A47G 2009/1018
USPC ..... 5/636, 637
See application file for complete search history.

(56) References Cited

U.S. PATENT DOCUMENTS 5,727,267 A * 3/1998 Keilhauer ..... A47G 9/109 5/636
5,884,351 A * 3/1999 Tonino ..... A47G 9/1081 5/636
6,321,402 B1 * 11/2001 Ming-Chung ..... A47G 9/10 5/639
6,484,336 B1 * 11/2002 Berke ..... A47G 9/10 5/636
6,902,537 B1 * 6/2005 Geisert ..... A61F 5/56 5/632
7,987,537 B1 * 8/2011 Hsiao ..... A47G 9/1081 5/636
10,905,265 B1 * 2/2021 Warner ..... A47G 9/007
2002/0138907 A1 * 10/2002 Wang ..... A47G 9/10 5/636
2004/0068799 A1 * 4/2004 Wilson ..... A47G 9/10 5/636

(Continued)

FOREIGN PATENT DOCUMENTS

CN 211511323 U 9/2020
KR 20-2016-0001977 U 6/2016

(Continued)

*Primary Examiner* — Justin C Mikowski
*Assistant Examiner* — George Sun
(74) *Attorney, Agent, or Firm* — Revolution IP, PLLC

(57) ABSTRACT

The present disclosure relates to a cervical spine supporting pillow and a method of manufacturing the same, and more particularly, to a cervical spine supporting pillow including: a first support layer formed to have a predetermined area so that a cervical spine and an occipital region of a user may be seated thereon; a second support layer formed with a plurality of air vents in a front surface and a rear surface thereof; and a third support layer formed to support the first support layer and the second support layer, wherein the third support layer, the second support layer, and the first support layer are sequentially stacked from bottom to top.

5 Claims, 7 Drawing Sheets

(56) References Cited

U.S. PATENT DOCUMENTS

2005/0076443 A1* 4/2005 Kruger ..... A47G 9/1081 5/636
2006/0064819 A1* 3/2006 Mollett ..... A47G 9/1081 5/636
2010/0237677 A1* 9/2010 Nam ..... A47G 9/10 297/391
2011/0078860 A1* 4/2011 Sun ..... A47G 9/10 5/636
2011/0271453 A1* 11/2011 Gandhi ..... A47G 9/1081 5/640
2012/0255126 A1* 10/2012 Abdo ..... A47G 9/109 5/636
2012/0260428 A1* 10/2012 Franklin ..... A47G 9/1009 5/636
2012/0278992 A1* 11/2012 Ou ..... A47G 9/0253 5/638
2013/0198961 A1* 8/2013 Davis ..... A47C 7/029 5/648
2014/0075677 A1* 3/2014 Raghuprasad ..... A47G 9/1027 5/636
2014/0317852 A1* 10/2014 Chen ..... A47G 9/109 5/644
2015/0089743 A1* 4/2015 Haworth ..... A47G 9/109 5/636
2015/0121626 A1* 5/2015 Carver ..... A47G 9/1081 5/636
2016/0022063 A1* 1/2016 Fulkerson ..... A47G 9/10 5/636
2017/0128307 A1* 5/2017 Kim ..... A61F 5/04
2017/0156958 A1* 6/2017 Roh ..... A47G 9/109
2018/0042409 A1* 2/2018 Johnson ..... A61G 13/121
2018/0063612 A1* 3/2018 Fuchs ..... A47G 9/1045
2018/0184822 A1* 7/2018 Wang ..... A47G 9/109
2018/0192799 A1* 7/2018 Fulkerson ..... A47G 9/1081
2019/0021526 A1* 1/2019 Deng ..... A47G 9/1081
2019/0069698 A1* 3/2019 Lin ..... A47G 9/1009
2020/0085611 A1* 3/2020 Peters ..... A61F 5/56
2020/0093297 A1* 3/2020 Dennewald ..... A47G 9/10
2020/0214481 A1* 7/2020 Sexton ..... A61H 1/0218
2020/0268183 A1* 8/2020 Murphy ..... A47G 9/109
2020/0375382 A1* 12/2020 Park ..... A47G 9/109
2021/0235900 A1* 8/2021 Choi ..... A47G 9/1009
2021/0298499 A1* 9/2021 Kim ..... A61H 39/04
2021/0361094 A1* 11/2021 Uribe ..... A47G 9/109
2022/0015547 A1* 1/2022 Hung ..... A47C 7/383

FOREIGN PATENT DOCUMENTS

KR 10-1645927 B1 8/2016
KR 10-2186827 B1 12/2020

* cited by examiner

[FIG. 1]
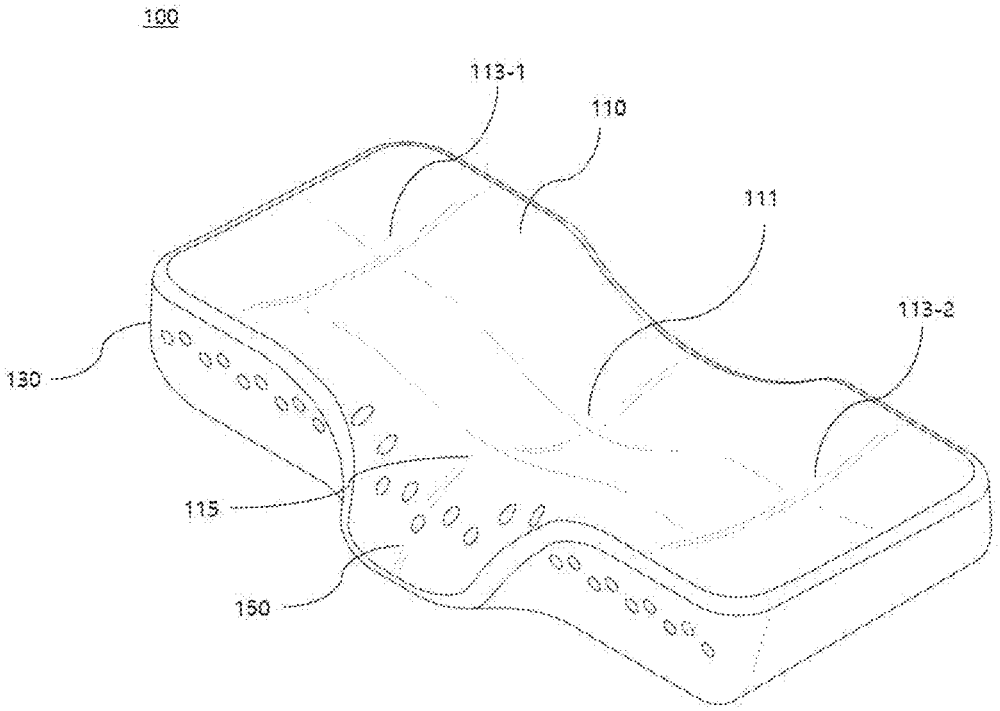
[FIG. 2A]
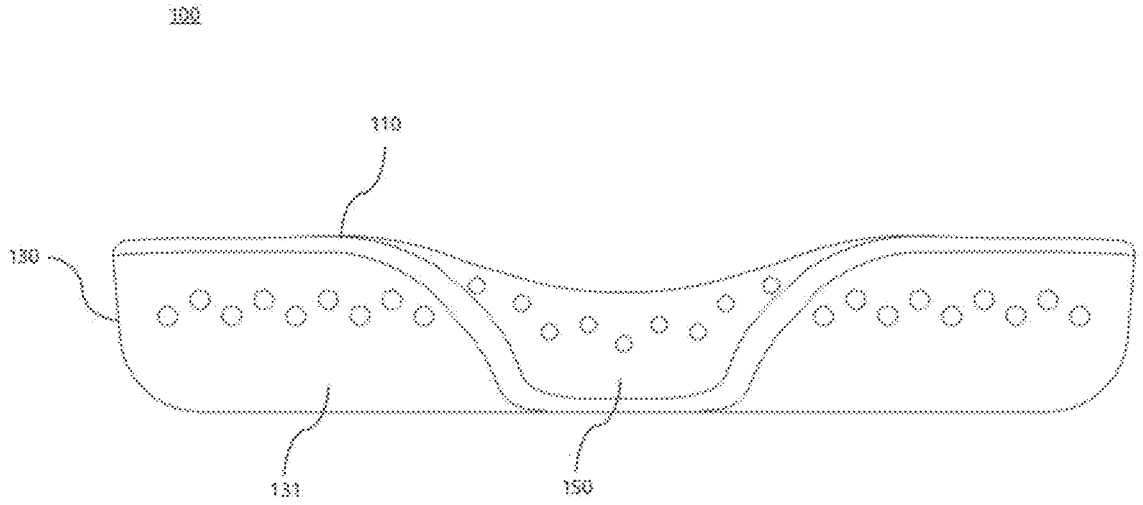

[FIG. 2B]
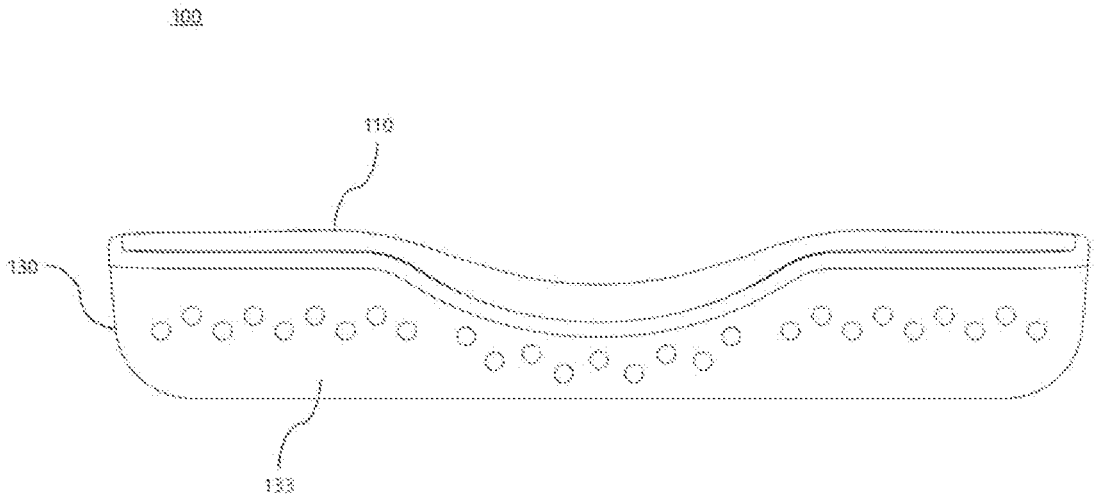
[FIG. 3]
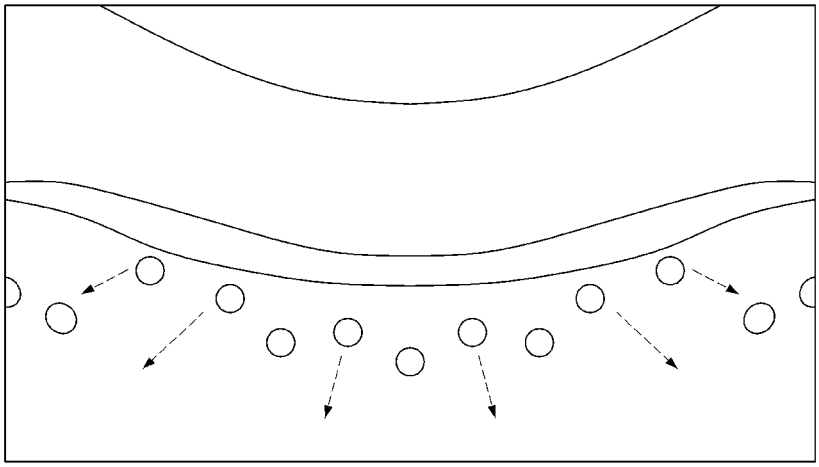

[FIG. 4]
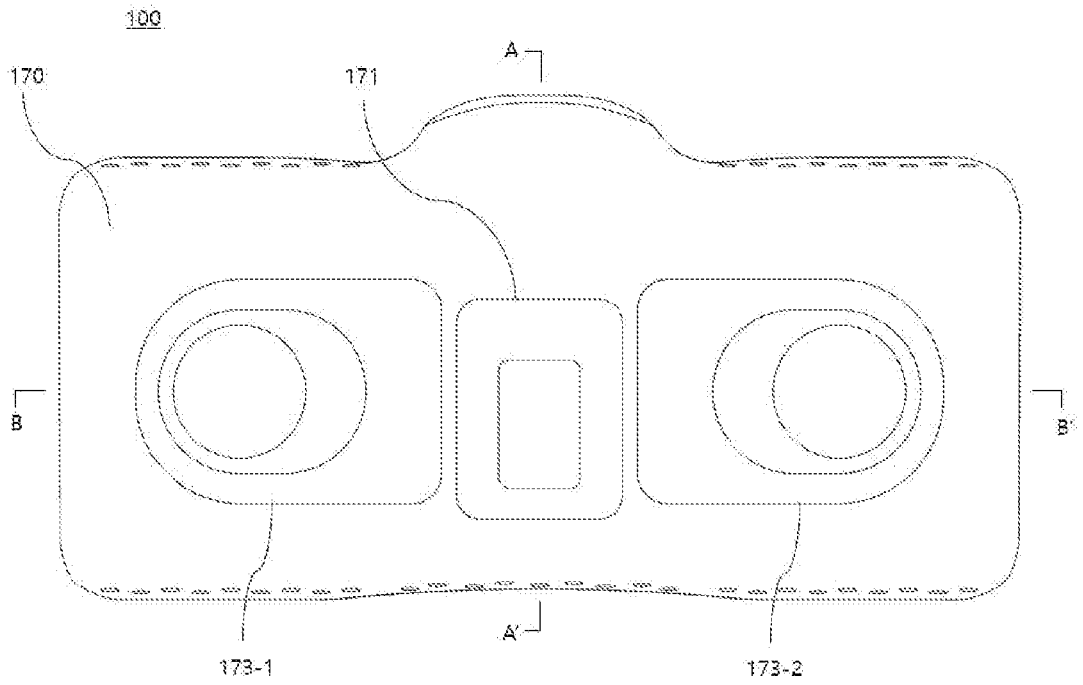
[FIG. 5A]
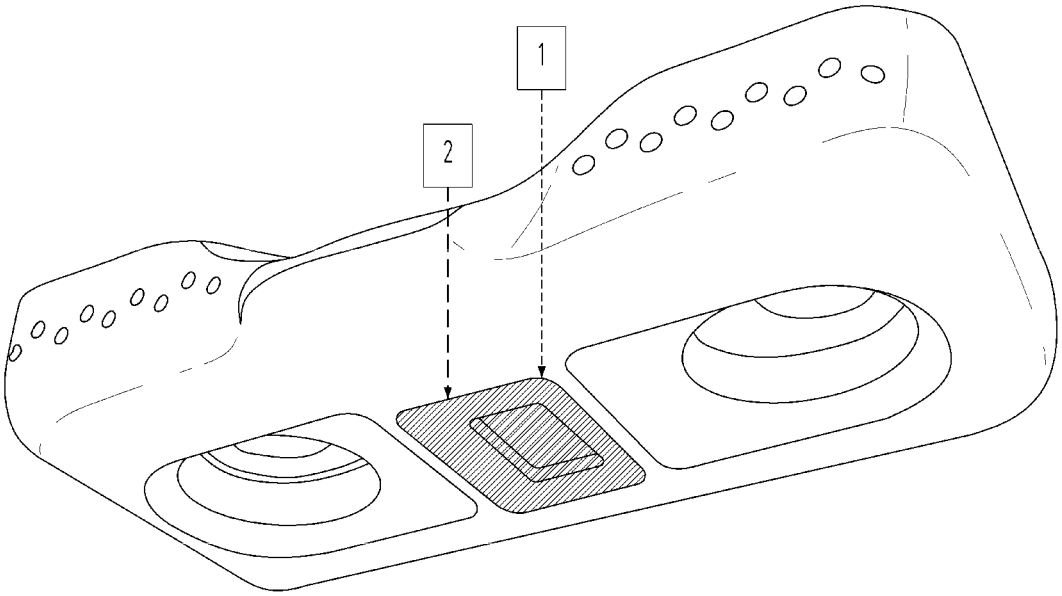

[FIG. 5B]
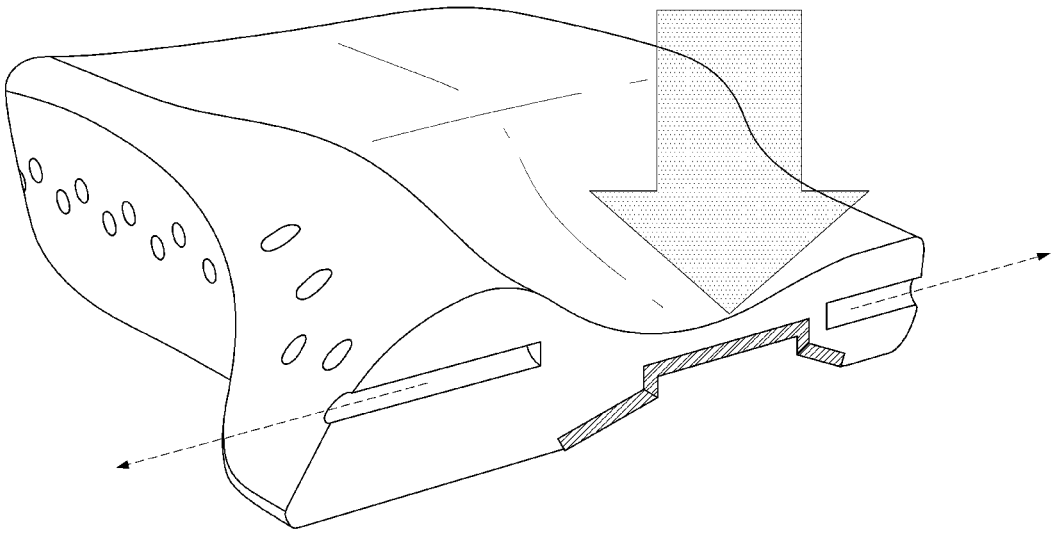
[FIG. 6A]
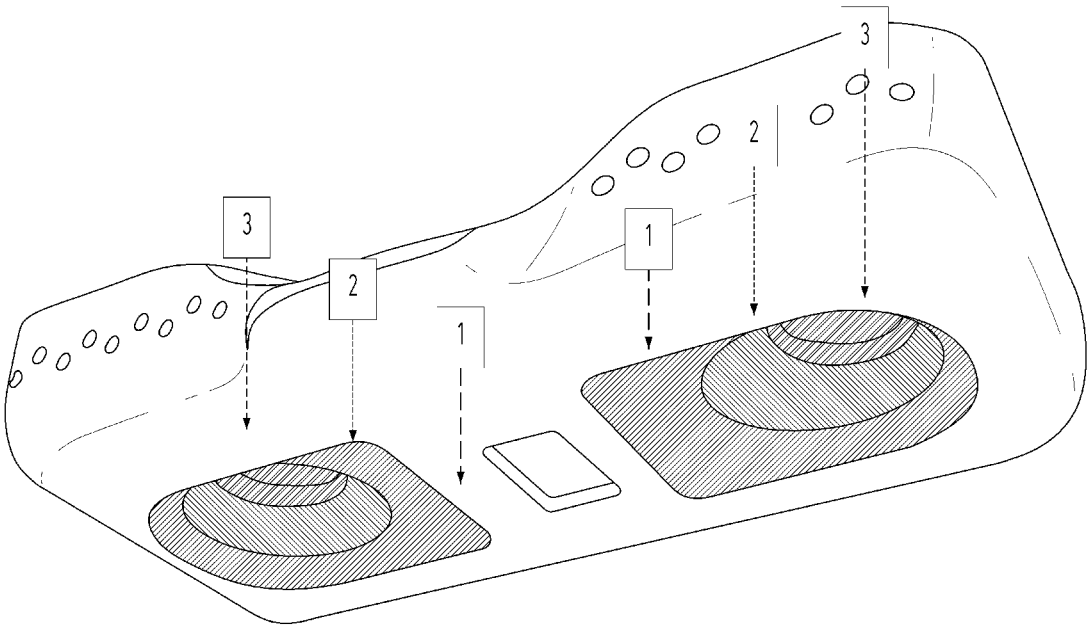

[FIG. 6B]
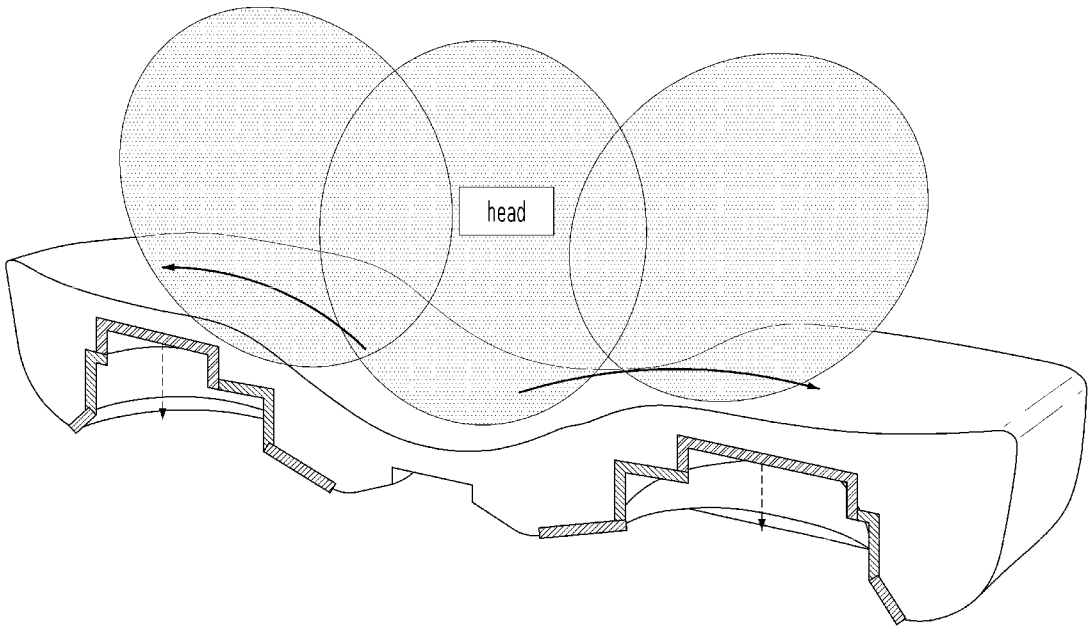
[FIG. 7]
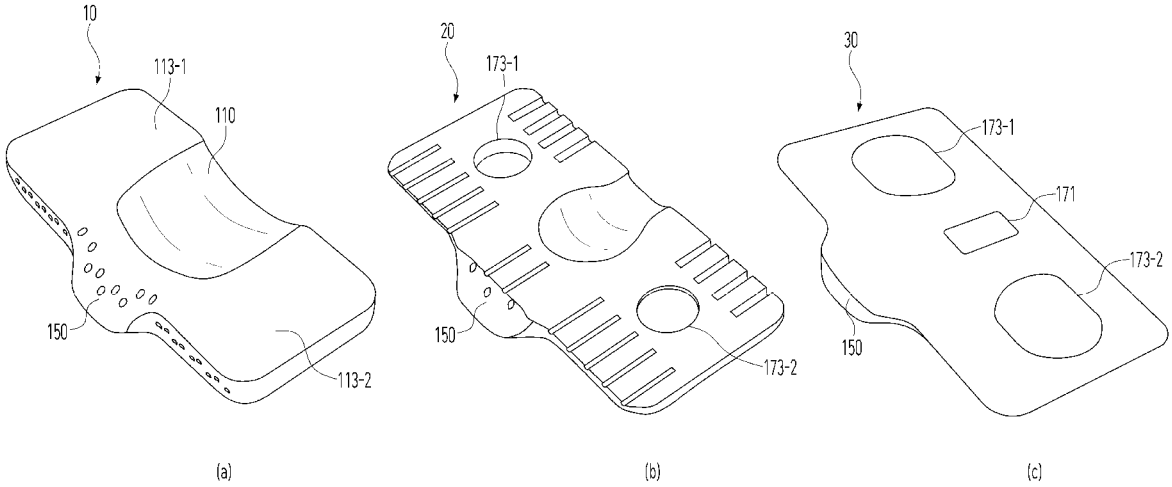

[FIG. 8]
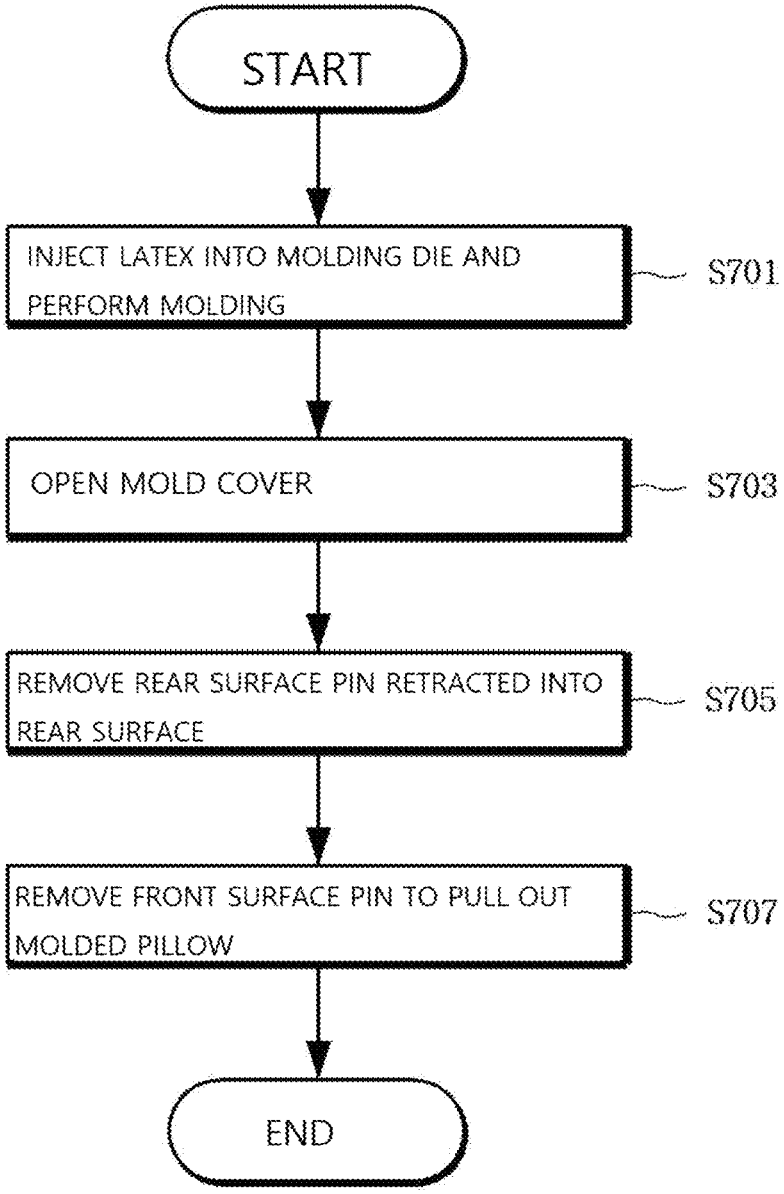

[FIG. 9]
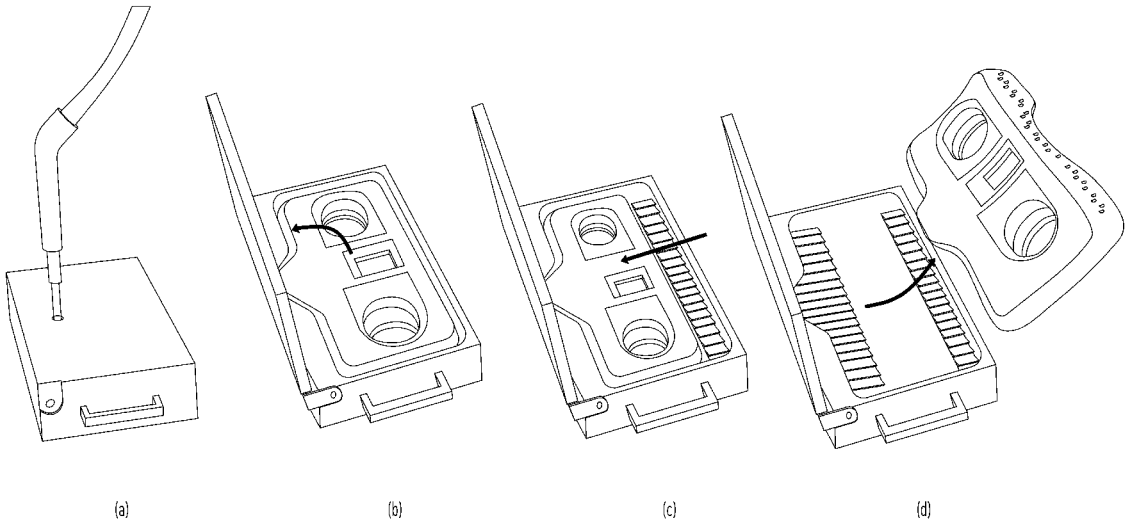

CERVICAL SPINE SUPPORTING PILLOW AND METHOD OF MANUFACTURING SAME

CROSS-REFERENCE TO RELATED APPLICATION

This application claims priority to and the benefit of Korean Patent Application No. 10-2020-0173035 filed on Dec. 11, 2020, the disclosure of which is incorporated herein by reference in its entirety.

BACKGROUND

1. Field of the Invention

The present disclosure relates to a cervical spine supporting pillow and a method of manufacturing the same, and more particularly, to a cervical spine supporting pillow capable of more stably supporting the cervical spine and the occipital region of a user, and a method of manufacturing the same.

2. Discussion of Related Art

Considering that sleep is repeated every day, greatly affects health during the course of life, and particularly, plays a large number of roles in maintaining life and health such as growth and regeneration of the body, biological recovery, strengthening of immunity, and recharging, the importance of sleep cannot be overemphasized. As the importance of sleep is recognized as described above, a sleep environment for taking a deep sleep has been studied, and among an ideal sleep environment, bedding, especially, pillows, plays a very important role.

Hereinafter, when external parts of the human body, affected by the sleep environment, are described in a general viewpoint, the head is large and heavy, the neck is thin, the chest area is wide with the left and right upper limbs located laterally through the shoulder joint, and the waist is generally thin but becomes thick when obese. Further, the buttocks protrude rearward, both lower extremities are located sideways, and thus the hip joint is the widest.

General pillows are configured to support only the head of the user, and thus a phenomenon in which the neck of the user is bent forward, that is, a case in which the cervical spine is deformed to form a straight line or an inverted "C" shape, frequently occurs, thereby causing cervical herniated nucleus.

In order to solve this problem, in recent years, cervical spine supporting pillows for supporting the cervical spine of the user have been proposed in various structures. It is known that the cervical spine supporting pillow not only supports the head of the user, but also supports the cervical spine of the user higher, and thus the cervical spine of the user forms a "C" shape, which is effective to some extent in reducing the incidence of cervical herniated nucleus.

However, the cervical spine supporting pillow according to the related art is mostly formed to have only a curve corresponding to the cervical spine to support the cervical spine of the user.

Thus, there is a need to develop a technology capable of more stably supporting the cervical spine and the occipital region of the user and as well as effectively dispersing the body pressure while providing a comfortable feeling of use.

SUMMARY OF THE INVENTION

The present disclosure is directed to providing a cervical spine supporting pillow capable of providing a comfortable feeling of use even while stably supporting the cervical spine and the occipital region of a user and also effectively dispersing body pressure, and a method of manufacturing the same.

The present disclosure is also directed to providing a cervical spine supporting pillow capable of preventing an ear pressing phenomenon and a slouching phenomenon that may occur when the user changes his/her posture during sleeping through a tension part formed with a plurality of stages to provide different tensions to lower portions of opposite sides thereof, and a method of manufacturing the same.

The purposes of the present disclosure are not limited to those described above, and other purposes not described will be clearly understood by those skilled in the art to which the present disclosure pertains from the following description. A cervical spine supporting pillow includes: a first support layer formed to have a predetermined area so that a cervical spine and an occipital region of a user may be seated thereon; a second support layer formed with a plurality of air vents in a front surface and a rear surface thereof; and a third support layer formed to support the first support layer and the second support layer, wherein the third support layer, the second support layer, and the first support layer are sequentially stacked from bottom to top and are formed integrally.

A method of manufacturing the cervical spine supporting pillow according to the present disclosure includes: injecting latex into a mold to perform molding; opening a cover of the mold and then pushing a rear surface of the mold using elasticity to remove a pin retracted into the rear surface; and removing a pin retracted into a front surface of the mold in a state in which the pin is removed from the rear surface to pull out a molded pillow.

BRIEF DESCRIPTION OF THE DRAWINGS

The above and other objects, features and advantages of the present disclosure will become more apparent to those of ordinary skill in the art by describing exemplary embodiments thereof in detail with reference to the accompanying drawings, in which:

FIG. 1 is a perspective view of a cervical spine supporting pillow according to an embodiment of the present disclosure;

FIG. 2A is a front view of the cervical spine supporting pillow according to the embodiment of the present disclosure, and FIG. 2B is a rear view of the cervical spine supporting pillow according to the embodiment of the present disclosure;

FIG. 3 is a view showing an example in which the body pressure is dispersed by a plurality of air vents formed in the cervical spine supporting pillow according to the embodiment of the present disclosure;

FIG. 4 is a bottom view of the cervical spine supporting pillow according to the embodiment of the present disclosure;

FIG. 5A is a view showing a first tension part in the cervical spine supporting pillow according to the embodiment of the present disclosure;

FIG. 5B is a cross-sectional view taken along line A-A' of FIG. 4;

FIG. 6A is a view showing a second tension part in the cervical spine supporting pillow according to the embodiment of the present disclosure;

FIG. 6B is a cross-sectional view taken along line B-B' of FIG. 4;

FIG. 7 is a cross-sectional view showing a configuration of each support layer formed in the cervical spine supporting pillow according to the embodiment of the present disclosure;

FIG. 8 is a flowchart showing a method of manufacturing a cervical spine supporting pillow according to an embodiment of the present disclosure; and FIG. 9 is a view schematically showing a process of manufacturing a cervical spine supporting pillow according to an embodiment of the present disclosure.

DETAILED DESCRIPTION OF EXEMPLARY EMBODIMENTS

Purposes and effects of the present disclosure and technical configurations for achieving the same will become clear with reference to embodiments described in detail below together with the accompanying drawings. In the description of the present disclosure, when it is determined that the detailed description of widely known functions or configurations may make the subject matter of the present disclosure unclear, the detailed description will be omitted. Further, terms described below are terms defined in consideration of functions in the present disclosure and may change according to the intention or custom of a user or an operator.

However, the present disclosure is not limited to embodiments disclosed below and may be implemented in various different forms. The present embodiments are merely provided to complete the disclosure of the present disclosure and fully inform those skilled in the art to which the present disclosure pertains of the scope of the disclosure, and the present disclosure is merely defined by the scope of the appended claims. Therefore, definitions thereof should be made based on the contents throughout the present specification.

Meanwhile, throughout the specification, when a first part is connected to a second part, this includes not only a case in which the first part is "directly connected" to the second part but also a case in which the first part is "indirectly connected" to the second part with a third part interposed therebetween. Further, when a part "includes" a component, this means that another component is not excluded but may be further included unless otherwise stated.

Hereinafter, the present disclosure will be described in more detail on the basis of the accompanying drawings.

FIG. 1 is a perspective view of a cervical spine supporting pillow according to an embodiment of the present disclosure.

Referring to FIG. 1, a cervical spine supporting pillow 100 according to the embodiment of the present disclosure may include a seating part 110, a side surface part 130, and an extended support part 150.

The seating part 110 corresponds to an upper surface where the head and the cervical spine of the user are in direct contact with each other and is formed to have a predetermined area. A portion of the seating part 110, where the cervical spine of the user is located, is formed in a curved shape so that a cervical spine support part 115 is maintained in a state in which the cervical spine of the user forms a C-shaped curve. In this case, the cervical spine support part 115 is formed with a plurality of air vents for dispersing the body pressure of the user.

Meanwhile, a portion of the seating part 110, on which the head of the user is seated, may be largely divided into a central part 111 and a pair of side parts 113-1 and 113-2.

Here, the central part 111 is a portion that supports the head when the user lies in a normal position and is formed in a curved shape corresponding to the head, and the pair of side portions 113-1 and 113-2 are portions that support the head when the user lies on the left or right side and are formed to have a height higher than those of the central part 111 and the cervical spine support part 115.

Moreover, a central portion of each of the central part 111 and the pair of side parts 113-1 and 113-2 is formed with a concave groove so that the occipital region or the side of the head of the user may be stably seated thereon.

The side surface parts 130 are formed to have a certain height and are provided with a plurality of air vents for dispersing the body pressure.

The extended support part 150 is provided at a central portion of the seating part 110, is formed to have an inclination from the cervical spine support part 115 to the bottom surface, guides the cervical spine of the user, and also stably supports the cervical spine. In this case, the extended support part 150 is formed to be tapered toward the bottom surface. In this way, by minimizing an empty space in the cervical spine of the user, the user may lie comfortably with no need to strain the neck to maintain the position.

FIG. 2A is a front view of the cervical spine supporting pillow according to the embodiment of the present disclosure, and FIG. 2B is a rear view of the cervical spine supporting pillow according to the embodiment of the present disclosure.

According to FIGS. 2A and 2B, the plurality of air vents are formed in a front side surface 131 and a rear side surface 133 of the side surface parts 130 and the extended support part 150, and the air vents have a non-linear arrangement in order to efficiently disperse the body pressure.

FIGS. 2A and 2B show, as an example, a case in which 27 air vents are formed in the front side surface 131, 27 air vents are formed in the rear side surface 133, that is, a total of 54 air vents are formed, this case is merely an embodiment, and the number of air vents is not limited and may be changed.

FIG. 3 is a view showing an example in which the body pressure is dispersed by the plurality of air vents formed in the cervical spine supporting pillow according to the embodiment of the present disclosure and enlargedly showing the cervical spine support part 115.

Referring to FIG. 3, the plurality of air vents formed in the cervical spine support part 115 disperse the body pressure generated when the user lies in the normal position. In this case, as the air vents are formed to have a non-linear arrangement, a force may be more efficiently dispersed.

As illustrated in FIG. 3, holes may be arranged in a zigzag form at regular intervals, but this is merely an embodiment, and the arrangement shape is not limited.

FIG. 4 is a bottom view of the cervical spine supporting pillow according to the embodiment of the present disclosure.

Referring to FIG. 4, a lower surface portion 170 including the bottom surface of the cervical spine supporting pillow 100 according to the embodiment of the present disclosure is formed to have a predetermined area.

In this case, a first tension part 171 is formed in the center of the lower surface portion 170, and second tension parts 173-1 and 173-2 are formed on opposite sides based on the center.

In this case, all the first tension part 171 and the pair of second tension parts 173-1 and 173-2 are configured in a multi-stage shape and thus provide a comfortable cushioning feeling to the user. Hereinafter, the first tension part 171 will be described with reference to FIGS. 5A and 5B, and the pair of second tension parts 173-1 and 173-2 will be described with reference to FIGS. 6A and 6B.

FIG. 5A is a view showing a first tension part in the cervical spine supporting pillow according to the embodiment of the present disclosure, and FIG. 5B is a cross-sectional view taken along line A-A' of FIG. 4.

Referring to FIGS. 5A and 5B, the first tension part 171 is formed at a position corresponding to the central portion 111 of the seating part 110 and is formed in two stages to provide double tension.

In this case, a lower stage has a wider width, and the two stages may be connected in the form of an oblique line. That is, a second stage (blue shading) located at the lowermost stage may be formed to have a wider width than a first stage (green shading) located at a superjacent stage thereof. In this case, the stages connected in the form of an oblique line may provide soft pressing when the user moves the head.

In detail, when the user lies down, when the body pressure is applied as the head of the user is seated on the seating part 110, the first stage of the first tension part 171 preferentially supports the head, and a force dispersed through the first stage is dispersed to the second stage connected in the form of an oblique line so as to support the head.

Accordingly, in a state in which the cervical spine is supported by the cervical spine support part 115, the head of the user is naturally pushed back by an empty space formed by each stage of the first tension part 171, the cervical spine forms a C-shaped curve, and at the same time, the head may be supported more stably.

FIG. 6A is a view showing a second tension part in the cervical spine supporting pillow according to the embodiment of the present disclosure, and FIG. 6B is a cross-sectional view taken along line B-B' of FIG. 4.

Referring to FIGS. 6A and 6B, the second tension parts 173-1 and 173-2 are formed at positions corresponding to the pair of side parts 113-1 and 113-2 and are formed in three stages to provide triple tension.

Like the first tension part 171 described above, the pair of second tension parts 173-1 and 173-2 also have a wider width as a stage is located lower. In this case, a third stage (blue shading) located at the lowermost stage and a second stage (red shading) located immediately above the third stage may be connected in the form of an oblique line, and the second stage and a first stage (green shading) located immediately above the second stage may be connected in the form of a right angle (step form). In this case, the stages connected in the form of an oblique line may provide soft pressing when the user moves the head.

For example, when the user turns his/her body to the left to seat the side head on the first side part 113-1 among the pair of side parts 113-1 and 113-2, and when the body pressure is applied thereby, the first stage of the second tension part 173-1 located at a position corresponding to the first side part 113-1 preferentially supports the head, the second stage supports the head in a wider area, and the force dispersed through the second stage is dispersed to the third stage connected in the form of an oblique line to support the head.

Accordingly, even in a state in which the user is lying on his/her side, the user may maintain a state in which ears of the user remain unpressed and comfortable due to the empty space formed by each stage, and thus discomfort when the user lies on his/her side may be relieved.

FIG. 7 is a cross-sectional view showing a configuration of each support layer formed in the cervical spine supporting pillow according to the embodiment of the present disclosure.

Referring to FIG. 7, the cervical spine supporting pillow 100 may include a plurality of support layers and may be roughly divided into a first support layer 10, a second support layer 20, and a third support layer 30. In this case, the respective support layers may be made of the same material and formed integrally.

First, the first support layer 10 is a layer in direct contact with the head of the user, corresponds to the upper surface, and includes the seating part 110 described above. The first support layer 10 is formed to have a curve corresponding to the cervical spine and the occipital line of the user.

Further, the first support layer 10 includes a part of the extended support part 150 formed to extend from a central portion of the front surface, and a plurality of air vents may be formed in the extended support part 150.

The second support layer 20 is a layer located below the first support layer 10, and a plurality of air vents may be formed in the front and rear surfaces thereof and a part of the extended support part 150 included therein.

The above-describe air vents look like holes when viewed from the outside, but may be formed to have a longitudinal direction, that is, to have a certain length toward the inside of the pillow.

Further, the central portion of the second support layer 20 may be partially formed with a recessed groove continued from the first support layer 10 so that the head of the user may be seated thereon, and opposite sides thereof may be formed with parts of the stages formed by the second tension parts 173-1 and 173-2.

Meanwhile, the third support layer 30 is a layer located below the second support layer 20 and serves to support the first support layer 10 and the second support layer 20 to more stably support the head of the user.

The first tension part 171 is formed in the central portion of the third support layer 30, and the second tension parts 173-1 and 173-2 formed on opposite sides of the second support layer 20 are connected to opposite sides of the third support layer 30 to form a larger area.

FIG. 8 is a flowchart showing a method of manufacturing a cervical spine supporting pillow according to an embodiment of the present disclosure, and FIG. 9 is a view schematically showing a process of manufacturing a cervical spine supporting pillow according to an embodiment of the present disclosure.

First, a manufacturer prepares a molding die corresponding to the outer shape of the cervical spine supporting pillow 100 and performs molding by injecting latex while covering a cover of the molding die as shown in FIG. 9A (S701). In this case, molding is performed at a temperature of about 100° C. for one hour.

Meanwhile, although not shown in FIG. 9, after step S701, the molded product is washed three times, then dehydrated, and dried for about 30 hours.

Thereafter, after the molded product is cured, as shown in FIG. 9B, the mold cover is opened (S703), and as shown in FIG. 9C, according to characteristics of the latex material, using elasticity thereof, the rear surface of the molded product is pushed, and thus the molded product is extracted from pins retracted into the rear surface (S705).

As shown in FIG. 9D, in this state, the rear surface is lifted up, the molded product is taken off of the pins retracted into the front surface, and thus the molded product, that is, the molded pillow, is pulled out (S707).

As described above, the present disclosure includes the first support layer formed to have a curve corresponding to the cervical spine and occipital line, the second support layer formed with a plurality of air vents, and a third support layer formed to provide a sense of tension to the occipital region while enabling stable support without slouching, and thus enables the user to feel a softer sense of use and a support force.

According to the present disclosure, not only a cervical spine and an occipital region of a user can be more stably supported but also a comfortable feeling of use can be provided even while a body pressure can be effectively dispersed.

Further, according to the present disclosure, an ear pressing phenomenon and a slouching phenomenon that may occur when a user changes his/her posture during sleeping can be prevented through a tension part formed with a plurality of stages to provide different tensions to lower portions of opposite sides thereof.

The effects of the present disclosure are not limited to those described above, and other effects not described will be clearly understood by those skilled in the art to which the present disclosure pertains from the following description.

In the present specification and the drawings, the exemplary embodiments of the present disclosure have been disclosed, and although specific terms are used, these terms are only used in a general sense to easily describe the technical contents of the present disclosure and help the understanding of the present disclosure and are not intended to limit the scope of the present disclosure. It is apparent to those skilled in the art to which the present disclosure pertains that other modifications based on the technical spirit of the present disclosure can be implemented in addition to the embodiments disclosed herein.

What is claimed is:

1. A cervical spine supporting pillow comprising:

a first support layer formed to have a predetermined area so that a cervical spine and an occipital region of a user are seated thereon;

a second support layer formed with a plurality of air vents in a front surface and a rear surface thereof; and a third support layer formed to support the first support layer and the second support layer, wherein the third support layer, the second support layer, and the first support layer are sequentially stacked from bottom to top and are formed integrally, wherein a first tension part having a two-stage structure is formed in a center of the third support layer, and each of a pair of second tension parts having a three-stage structure is formed on opposite sides of centers of the second support layer and the third support layer, wherein each second tension part is disposed to be spaced apart from the air vents, wherein each second tension part formed on the second support layer is interposed between the first support layer and the third support layer.

2. The cervical spine supporting pillow of claim 1, wherein each of the plurality of air vents is formed in a shape of a hole and has a predetermined length in a horizontal direction.

3. The cervical spine supporting pillow of claim 2, wherein the plurality of air vents are non-linearly arranged to disperse a body pressure.

4. The cervical spine supporting pillow of claim 1, further comprising an extended support part that is formed, in a state in which the third support layer, the second support layer, and the first support layer are sequentially stacked, in a central portion of a front surface of the stacked object to protrude and extend to have an inclination from the front surface toward a bottom surface, wherein the extended support part supports and guides the cervical spine of the user.

5. The cervical spine supporting pillow of claim 1, wherein the first tension part and the second tension parts are configured to have a wider width as a stage is located lower.

* * * * *